US010470521B2

(12) United States Patent
Iuchi et al.

(10) Patent No.: US 10,470,521 B2
(45) Date of Patent: Nov. 12, 2019

(54) SOLE STRUCTURE FOR SHOES AND SHOE WITH THE SOLE STRUCTURE

(71) Applicant: MIZUNO CORPORATION, Osaka-shi, Osaka (JP)

(72) Inventors: Kazunori Iuchi, Osaka (JP); Takeshi Takeshita, Osaka (JP); Shogo Matsui, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 374 days.

(21) Appl. No.: 15/281,477

(22) Filed: Sep. 30, 2016

(65) Prior Publication Data

US 2017/0325543 A1 Nov. 16, 2017

(30) Foreign Application Priority Data

May 11, 2016 (JP) ..... 2016-095384

(51) Int. Cl.
*A43B 13/12* (2006.01)
*A43B 13/18* (2006.01)
(Continued)

(52) U.S. Cl.
CPC ..... *A43B 13/186* (2013.01); *A43B 13/04* (2013.01); *A43B 13/127* (2013.01); *A43B 13/141* (2013.01); *A43B 13/188* (2013.01)

(58) Field of Classification Search
CPC ..... A43B 13/145; A43B 13/12; A43B 13/41; A43B 5/00; A43B 5/06; A43B 5/0419;
(Continued)

(56) References Cited

U.S. PATENT DOCUMENTS 4,439,937 A * 4/1984 Daswick ..... A43B 13/10 36/107
5,528,842 A * 6/1996 Ricci ..... A43B 13/12 36/103
(Continued)

FOREIGN PATENT DOCUMENTS

JP 11-203 A 1/1999
JP 11-332606 A 12/1999
(Continued)

OTHER PUBLICATIONS

Office Action issued by the Japanese Patent Office for related Japanese Patent Application No. 2016-095384 dated Sep. 26, 2017.

*Primary Examiner* — Timothy K Trieu
(74) *Attorney, Agent, or Firm* — Troutman Sanders LLP; Daniel Sharpe

(57) ABSTRACT

A sole structure includes an outsole having a ground surface as a lower surface; a midsole stacked on a top of the outsole and made of an elastic material; and a supporter provided around a middle of the midsole in a thickness direction, and extending longitudinally to include a heel region corresponding to a heel of a foot. The supporter includes a base provided in a central region of the heel region in a foot width direction, and a corrugated side provided continuously with each side of the base in the foot width direction, and including a ridge with its apex located above the base, and a groove provided continuously with a rear of the ridge with its bottom located below the base at the rear of the heel region.

10 Claims, 10 Drawing Sheets

(51) Int. Cl.
*A43B 13/04* (2006.01)
*A43B 13/14* (2006.01)

(58) Field of Classification Search
CPC ..... A43B 7/142; A43B 7/22; A43B 23/22; A43B 23/222; A43B 23/227
USPC ..... 36/25 R, 30 R, 76 R, 72 A
See application file for complete search history.

(56) References Cited

U.S. PATENT DOCUMENTS

| | | | | |
|---|---|---|---|---|
| 6,219,939 | B1 | 4/2001 | Kita et al. | |
| 6,219,940 | B1 | 4/2001 | Kita | |
| 6,389,713 | B1 | 5/2002 | Kita | |
| 6,497,058 | B2 | 12/2002 | Dietrich et al. | |
| 8,567,093 | B2 * | 10/2013 | Sato | A43B 13/026 36/27 |
| 9,451,805 | B2 * | 9/2016 | Barnes | A43B 13/183 |
| 2003/0000109 | A1 * | 1/2003 | Kita | A43B 13/12 36/30 R |
| 2013/0318834 | A1 * | 12/2013 | Mueller | A43B 13/127 36/30 R |
| 2015/0013185 | A1 | 1/2015 | Elder et al. | |
| 2016/0081427 | A1 | 3/2016 | Iuchi et al. | |

FOREIGN PATENT DOCUMENTS

| | | | |
|---|---|---|---|
| JP | 2004-242692 | A | 9/2004 |
| JP | 2014-008298 | A | 1/2014 |
| JP | 2014-236886 | A | 12/2014 |

* cited by examiner

SOLE STRUCTURE FOR SHOES AND SHOE WITH THE SOLE STRUCTURE

CROSS-REFERENCE TO RELATED APPLICATION

This application claims priority to Japanese Patent Application No. 2016-095384 filed on May 11, 2016, the entire disclosure of which is hereby incorporated by reference.

BACKGROUND OF THE INVENTION

The present disclosure relates to a sole structure for shoes and a shoe with the sole structure.

A sole structure for athletic shoes has been generally widely known, which includes, as major components, a midsole made of a soft elastic material and an outsole bonded to the lower surface of the midsole, and focuses on cushioning. As an improvement of this sole structure, for example, Japanese Unexamined Patent Publication No. 11-332606, suggests a sole structure for athletic shoes that reduces excessive deformation of the shoes in a foot width direction (i.e., transverse deformation) when the shoes are touching the ground.

The sole structure disclosed in this Japanese Unexamined Patent Publication No. 11-332606 includes a midsole, a corrugated sheet, and an outsole. The midsole cushions the shock to the bottom of the shoe touching the ground. The corrugated sheet is disposed inside the midsole in the position corresponding to the heel. The outsole is bonded to the lower surface of the midsole and has a ground surface that touches the ground.

SUMMARY OF THE INVENTION

In general, when a shoe touches the ground while the wearer is walking or running, a load path occurs, which represents the shift of the wearer's body weight from the lateral side of the rearfoot (i.e., a heel region) of the wearer through a central region of the heel region in the foot width direction, a central portion of the midfoot, and the medial side of the forefoot to the tiptoes.

The sole structure of the Japanese Unexamined Patent Publication No. 11-332606 provides not only cushioning via the midsole and the outsole, but also heel stability via the corrugated sheet. In the corrugated sheet of the sole structure, however, ridges and grooves that form corrugations rising and falling are arranged alternately and continuously in the longitudinal direction throughout the heel. Thus, for example, at the rear of the heel, although the corrugated sheet has increased stiffness, the midsole increases its cushioning insufficiently. In particular, initial shock when the shoe touches the ground at the rear of the heel on the lateral side cannot be cushioned sufficiently. In the central region of the heel in the foot width direction between the medial and lateral sides, the stiffness increased by the corrugated sheet hinders optimum distribution of the shock in the sole structure when the shoe touches the ground while the wearer is walking or running. This leads to insufficient cushioning of the shock in the sole structure.

In short, the sole structure of Japanese Unexamined Patent Publication No. 11-332606 is not configured to allow the wearer of shoes who is walking or running to shift his or her body weight on a foot along an optimum load path.

The present disclosure was made in view of these problems, and it is therefore an object of the present disclosure to allow the wearer of shoes who is walking or running to shift his or her body weight on a foot along an optimum load path while supporting the entire heel stably.

In order to achieve the object, a first aspect of the present disclosure provides a sole structure for shoes. The sole structure includes an outsole having a ground surface as a lower surface; a midsole stacked on a top of the outsole and made of an elastic material; and a supporter provided around a middle of the midsole in a thickness direction, extending longitudinally to include a heel region corresponding to a heel of a foot, and being a thin layer harder than the midsole. The supporter includes a base provided in a central region of the heel region in a foot width direction, and a corrugated side provided continuously with each side of the base in the foot width direction, and including a ridge curving and protruding upward with its apex located above the base, and a groove provided continuously with a rear of the ridge, curving and protruding downward with its bottom located below the base. The bottom of the groove is located at a rear of the heel region. In a region extending from the groove on a medial side to the groove on a lateral side, the midsole on a top of the supporter has a greater thickness on the medial and lateral sides of the heel region than in a central portion of the heel region in the foot width direction.

In the first aspect, at the rear of the heel region, there is a difference in the thickness of the midsole on the top of the supporter in the region extending from the groove of the medial side to the groove of the lateral side. This difference increases the cushioning, which is provided by the midsole on the supporter, more effectively on the medial and lateral sides than in the central portion in the foot width direction. This particularly cushions the initial shock caused when a shoe touches the ground at the rear of the heel region on the lateral side. In the central region of the heel region in the foot width direction, the base of the supporter does not curve like the corrugated sides. This structure of the base easily distributes the shock throughout the base when the shoe touches the ground, thereby cushioning the shock on the central region of the heel region in the foot width direction more effectively than in a case where the shock is cushioned by the midsole only. In addition, the raised and grooves of the corrugated sides of the supporter are stiff enough to prevent the sole structure from being deformed largely at the heel region, and prevent the foot (particularly the ankle) from falling excessively toward the medial or lateral side, even when vertical shock is caused onto the sole support surface of the midsole. This stabilizes the heel region to allow the wearer who is walking or running to shift his or her body weight along an optimum load path. In this manner, the sole structure allows the wearer who is walking or running to shift the body weight on the foot along the optimum load path, while supporting the heel region stably via the supporter.

A second aspect of the present disclosure is an embodiment of the first aspect. In this aspect, the base may have a flat surface.

In this second aspect, the base of the supporter may be a flat surface. Thus, in the central region of the heel region in the foot width direction, the shock caused when the shoe touches the ground is distributed throughout the base to hardly cause local deformation of the base. That is, the entire base is bent and deformed easily enough to stably absorb the shock caused on the central region of the heel region in the foot width direction.

A third aspect of the present disclosure is an embodiment of the first or second aspect. In this aspect, the base may extend longitudinally throughout the heel region.

In this third aspect, since the base of the supporter extends longitudinally throughout the heel region, the base cushions the shock caused when the shoe touches the ground throughout the heel region in the longitudinal direction in the central region of the heel region in the foot width direction.

A fourth aspect of the present disclosure is an embodiment of any one of the first to third aspects. In this aspect, the ridge may include a plurality of ridges being arranged longitudinally continuously with each other on the medial side. The groove may be provided continuously with a rear of rearmost one of the ridges.

In this fourth aspect, the ridges on the medial side further increase the stiffness of the corrugated side on the medial side. This prevents the foot from falling excessively toward the medial side, thereby stabilizing the heel region to allow the wearer who is walking or running to shift his or her body weight along an optimum load path, for example.

A fifth aspect of the present disclosure is an embodiment of any one of the first to fourth aspects. In this aspect, the ridge may include a plurality of ridges being arranged longitudinally continuously with each other on the lateral side. The groove may be provided continuously with a rear of rearmost one of the ridges.

In this fifth aspect, the stiffness of the corrugated side is further increased on the lateral side of the heel region to allow the wearer to smoothly shift his or her body weight at side-step movements on the lateral side of the heel region, when he or she is playing sports such as baseball, football, volleyball, and basketball.

A sixth aspect of the present disclosure is an embodiment of the fourth or fifth aspect. In this aspect, an apex of each of the ridges may be located within a region extending from a front of the heel region to a longitudinal center thereof.

In this sixth aspect, since the apex of each ridge is located within the region extending from the front of the heel region to the longitudinal center, the stiffness of the corrugated side is increased particularly from the front of the heel region to the longitudinal center.

A seventh aspect of the present disclosure provides a shoe including the sole structure of any one of the first to sixth aspects.

The shoe according to this seventh aspect achieves the same or similar effects and advantages to those in the first to sixth aspects.

As can be seen from the foregoing, the present disclosure allows the wearer who is walking or running to shift his or her body weight on a foot along an optimum load path, while supporting the entire heel region stably via a supporter.

DETAILED DESCRIPTION

Embodiments of the present disclosure will now be described in detail with reference to the drawings. The following description of the embodiments are mere examples by nature, and are not intended to limit the scope, application, or uses of the present disclosure.

First Embodiment

Figure 1:
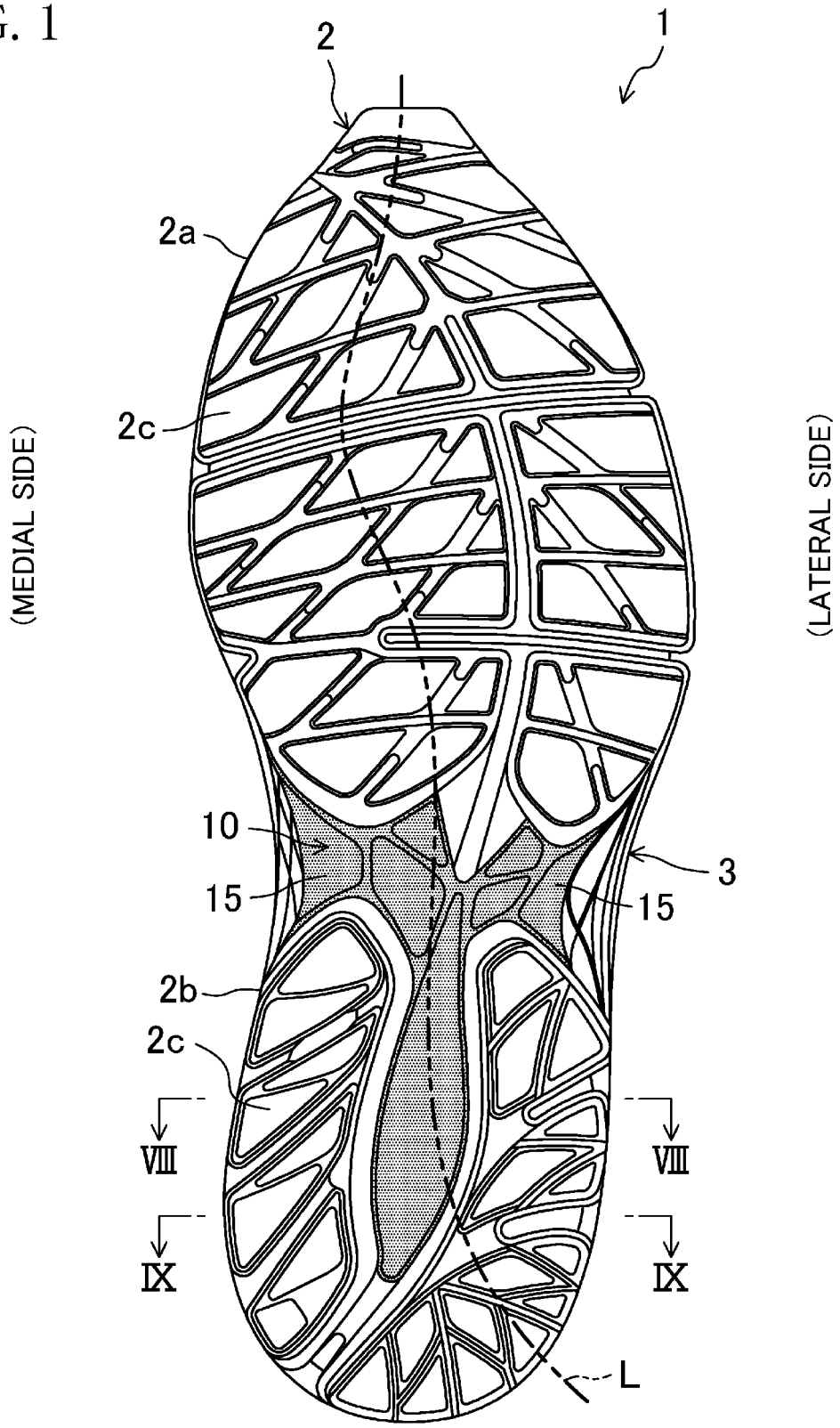
FIG. 1 is a bottom view of a sole structure for shoes according to a first embodiment of the present disclosure.
Figure 2:
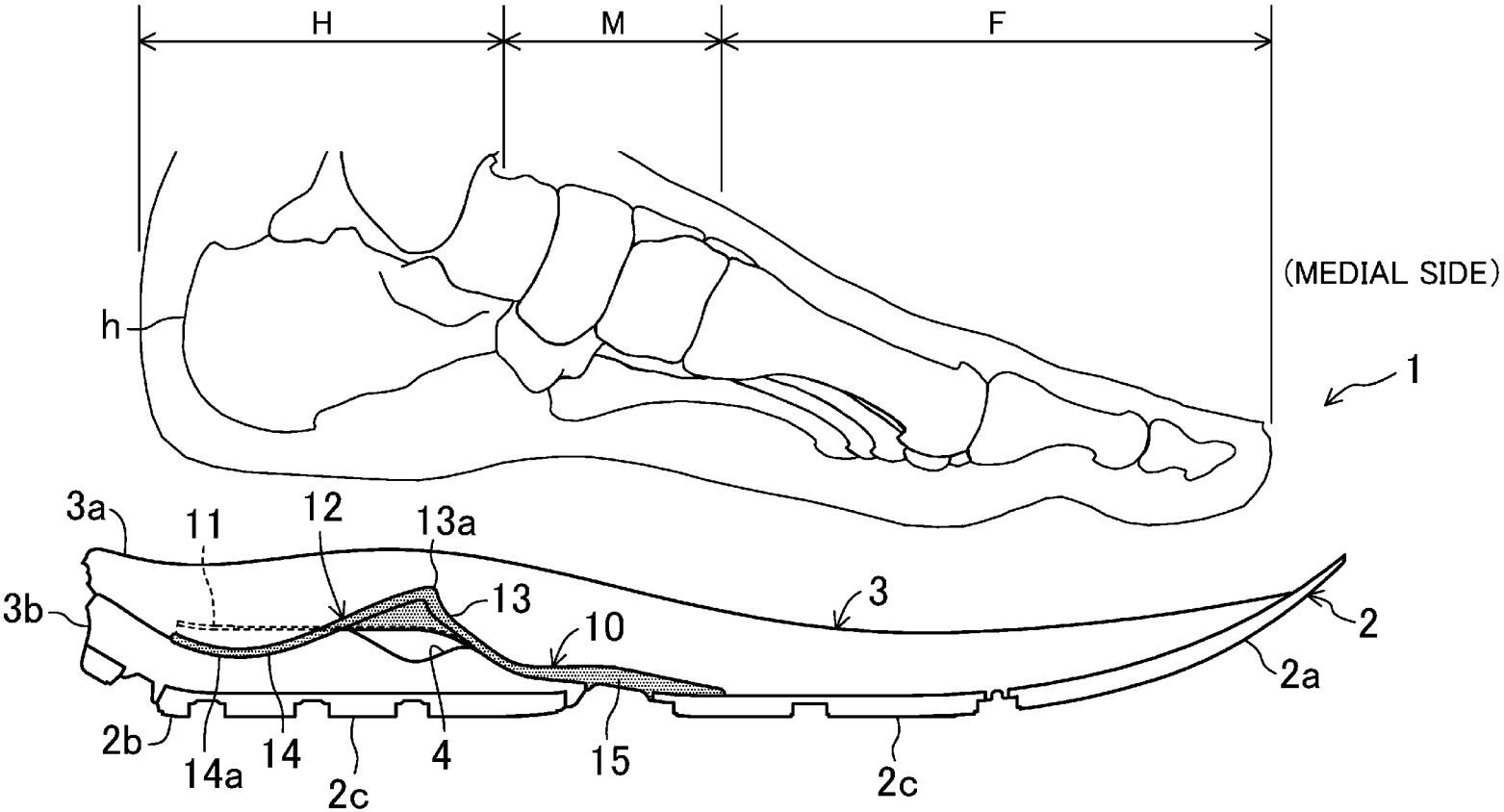
FIG. 2 is a medial side view of the structures of a human foot and the sole structure overlapping with each other.
Figure 3:
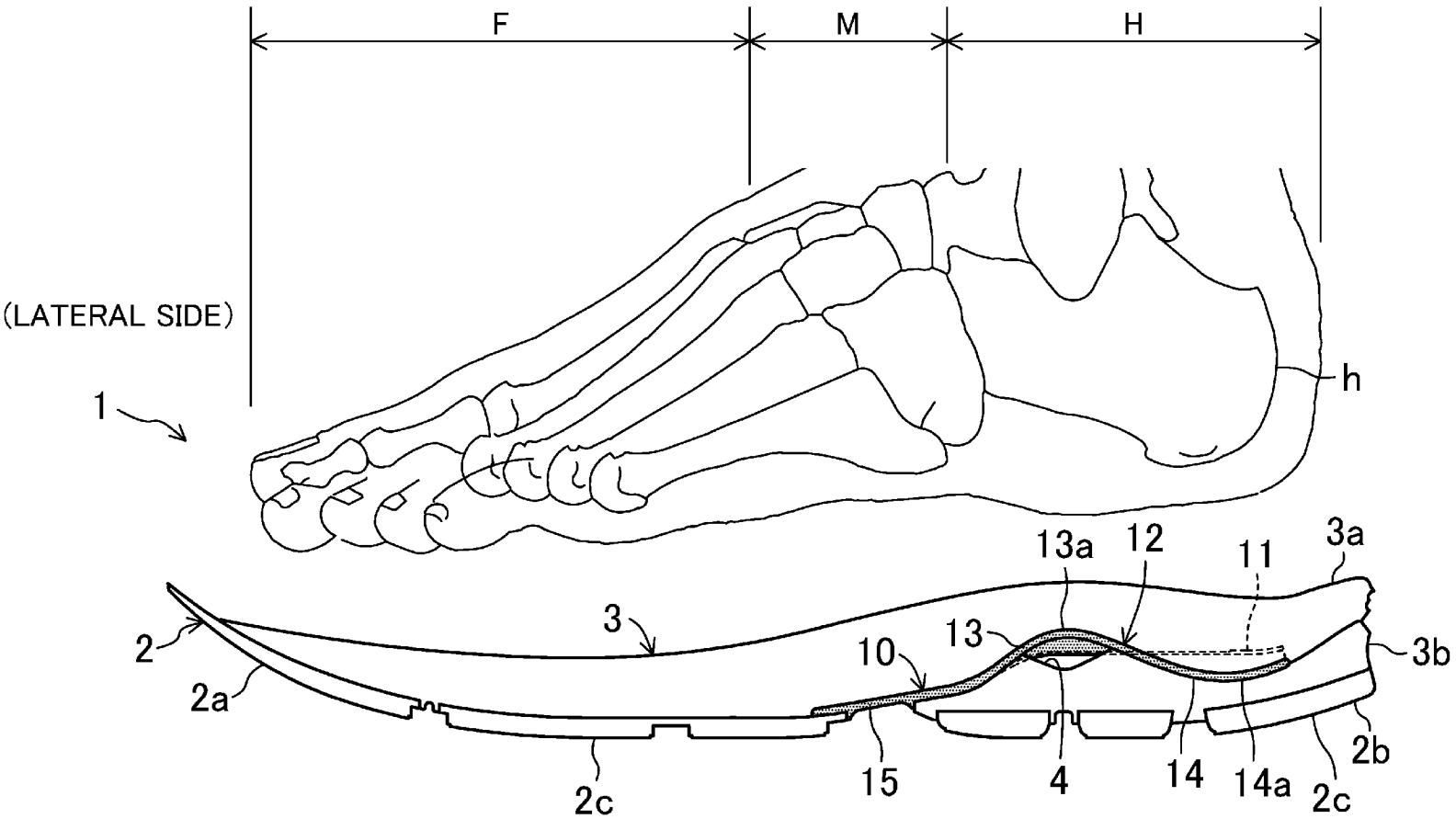
FIG. 3 is a lateral side view the structure of a human foot and the sole structure that overlap with each other.

FIGS. 1-3 illustrate an overall sole structure 1 for shoes according to a first embodiment of the present disclosure. A pair of shoes including an upper structure (not shown) on this sole structure 1 may be used, for example, as athletic shoes for running and various sports, sneakers for daily use, or rehabilitation shoes. FIGS. 1-3 show the sole structure 1 for a left shoe only. A sole structure 1 for a right shoe is symmetrical to the sole structure 1 for the left shoe. In the following description including the embodiments and variations, only the sole structure 1 for the left shoe will be described and, the description of the sole structure 1 for the right shoe will be omitted. In the following description, the expressions "above," "upward," "on a/the top of," "below," "downward," and "under" represent the vertical positional relationship between respective parts of the sole structure 1, and "front" and "rear" represent the longitudinal positional relationship in the sole structure 1. The expressions "medial side" and "lateral side" represent the positional relationship between respective parts in the foot width direction in the sole structure 1.

Outsole

The sole structure 1 includes an outsole 2 extending from tiptoes of a wearer's forefoot F to the rear of a rearfoot (i.e., the heel) H thereof. This outsole 2 is made of a hard elastic material harder than a midsole 3, which will be described later. Examples of suitable materials include thermoplastic resins such as ethylene-vinyl acetate copolymer (EVA), thermosetting resins such as polyurethane (PU), and rubber materials such as butadiene rubber and chloroprene rubber.

As shown in FIGS. 1-3, the outsole 2 is comprised of a front outsole 2*a* and a rear outsole 2*b*. The front outsole 2*a* supports a front region extending from the forefoot F to the front of a midfoot M. The rear outsole 2*b* is separated from this front outsole 2*a*, and supports a rear region extending from the rear of the midfoot M to the rearfoot H. A ground surface 2*c* touching the ground is formed on the lower surface of each of the front and rear outsoles 2*a* and 2*b*. The rear outsole 2*b* curves substantially in a C-shape as viewed from the bottom. Inside the C-shape, part of a base 11 of a supporter 10, which will be described later, is exposed. The base 11 is located in a central region of the heel region H in the foot width direction.

Midsole

As shown in FIGS. 2 and 3, the sole structure 1 includes the midsole 3 that supports the sole surface from the wearer's forefoot F to the rearfoot H. This midsole 3 is made of a soft elastic material. Examples of suitable materials include thermoplastic synthetic resins such as ethylene-vinyl acetate copolymer (EVA) and their foams, thermosetting resins such as polyurethane (PU) and their foams, and rubber materials such as butadiene rubber and chloroprene rubber and their foams. The bottom of the midsole 3 is bonded to the top of the outsole 2 (i.e., the front and rear outsoles 2*a* and 2*b*) with an adhesive such that the midsole 3 is stacked on the top of the outsole 2. An upper structure is provided on the peripheral edge of the midsole 3 to cover the wearer's foot.

Figure 8:
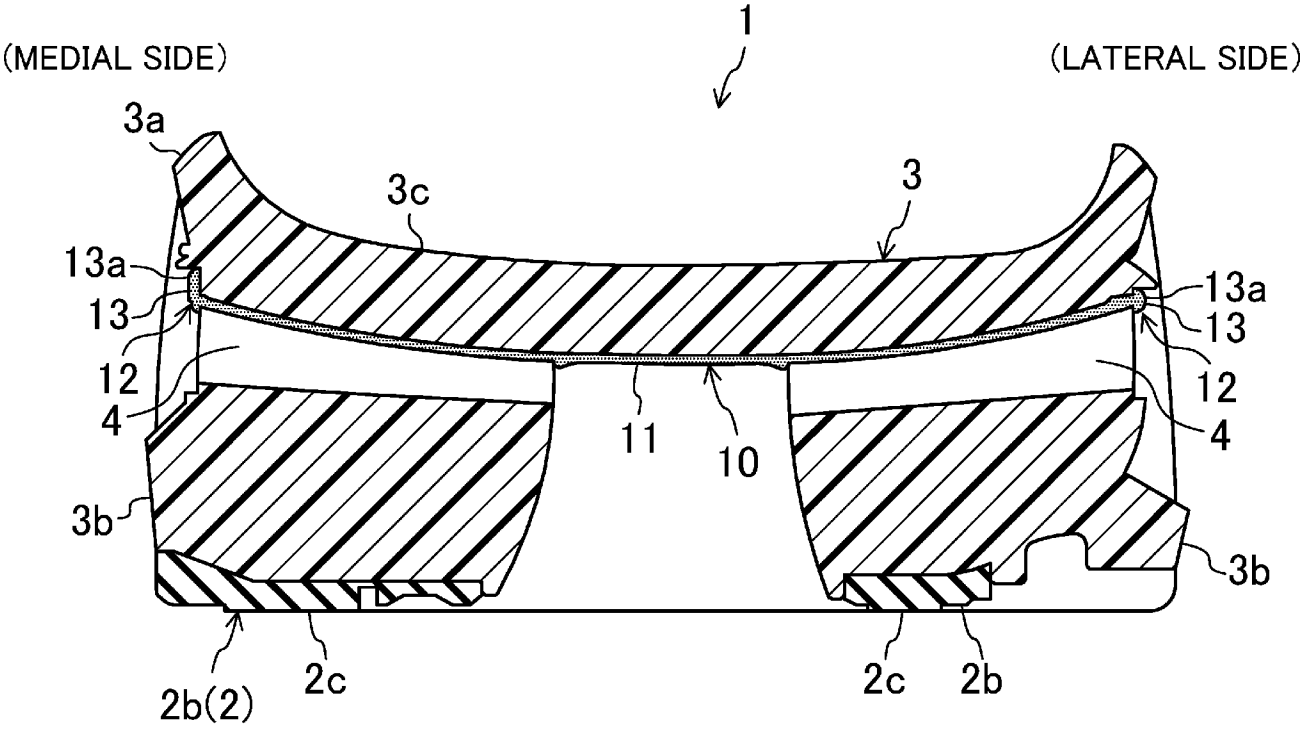
FIG. 8 is a cross-sectional view taken along the plane VIII-VIII of FIG. 1.
Figure 9:
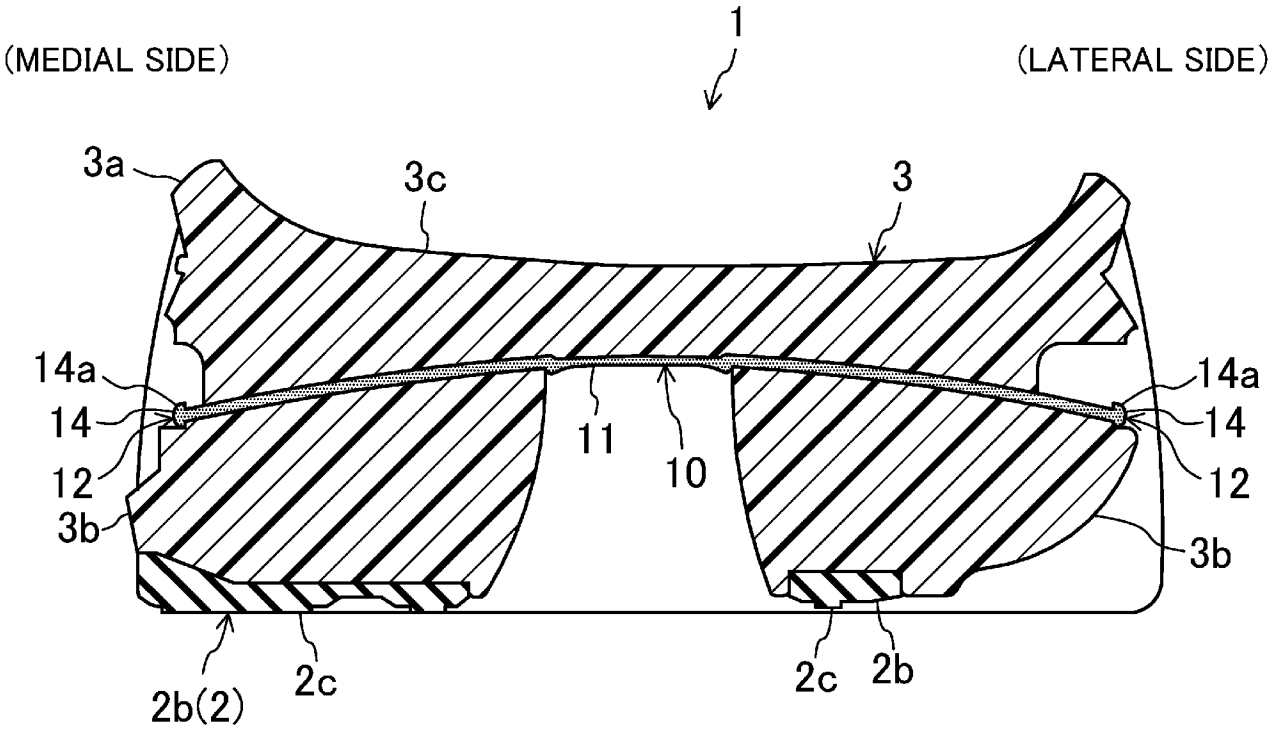
FIG. 9 is a cross-sectional view taken along the plane IX-IX of FIG. 1.

As shown in FIGS. 8 and 9, a sole support surface 3*c* extends longitudinally on the top of the midsole 3 to support the sole surface from the tiptoes of the wearer's forefoot F to the rear of the rearfoot H. This sole support surface 3*c* curves downward toward the outsole 2. The peripheral edge of the sole support surface 3*c* corresponding to the medial and lateral sides is located above the central portion of the sole support surface 3*c* in the foot width direction.

The midsole 3 is divided vertically at its rear that substantially corresponds to the rear outsole 2*b*. That is, the midsole 3 includes an upper midsole 3*a* and a lower midsole 3*b*. The upper midsole 3*a* has the sole support surface 3*c*. The lower midsole 3*b* is stacked under the upper midsole 3*a* in the region extending from the rear of the wearer's midfoot M to the rearfoot H. These upper and lower midsoles 3*a* and 3*b* increase cushioning of the sole structure 1, particularly in the region extending from the rear of the midfoot M to the rearfoot H.

Supporter

As one of the features of the present disclosure, the sole structure 1 includes the supporter 10 that is located around a middle of the midsole 3 in the thickness direction between the upper and lower midsoles 3*a* and 3*b*, and includes the heel region H corresponding to the heel of a foot. This supporter 10 is a thin layer that is harder than the midsole 3 and may be made of a hard elastic material. Examples of specific hard elastic materials include thermoplastic resins such as thermoplastic polyurethane (TPU), polyamide elastomer (PAE), and an ABS resin, and thermosetting resins such as an epoxy resin and an unsaturated polyester resin. Optionally, the supporter 10 may also be made of fiber reinforced plastic (FRP) comprised of a reinforcement fiber such as a carbon fiber, an aramid fiber, or a glass fiber, and a matrix resin such as a thermosetting resin or a thermoplastic resin.

As shown in FIGS. 1-3, the supporter 10 extends longitudinally from the wearer's midfoot M to the rear of the rearfoot (i.e., the heel region) H, and is sandwiched between the upper and lower midsoles 3*a* and 3*b*. As shown in FIGS. 8 and 9, the width (i.e., the length measured in the foot width direction) of the supporter 10 is substantially equal to the width (i.e., the length measured in the foot width direction) of the upper midsole 3*a*. The lower surface of the supporter 10 is bonded to the upper surface of the lower midsole 3*b* with an adhesive, for example. The upper surface of the supporter 10 is bonded to the lower surface of the upper midsole 3*a* with an adhesive, for example. In FIGS. 1-3, the supporter 10 is highlighted by hatching with dots.

Figure 4:
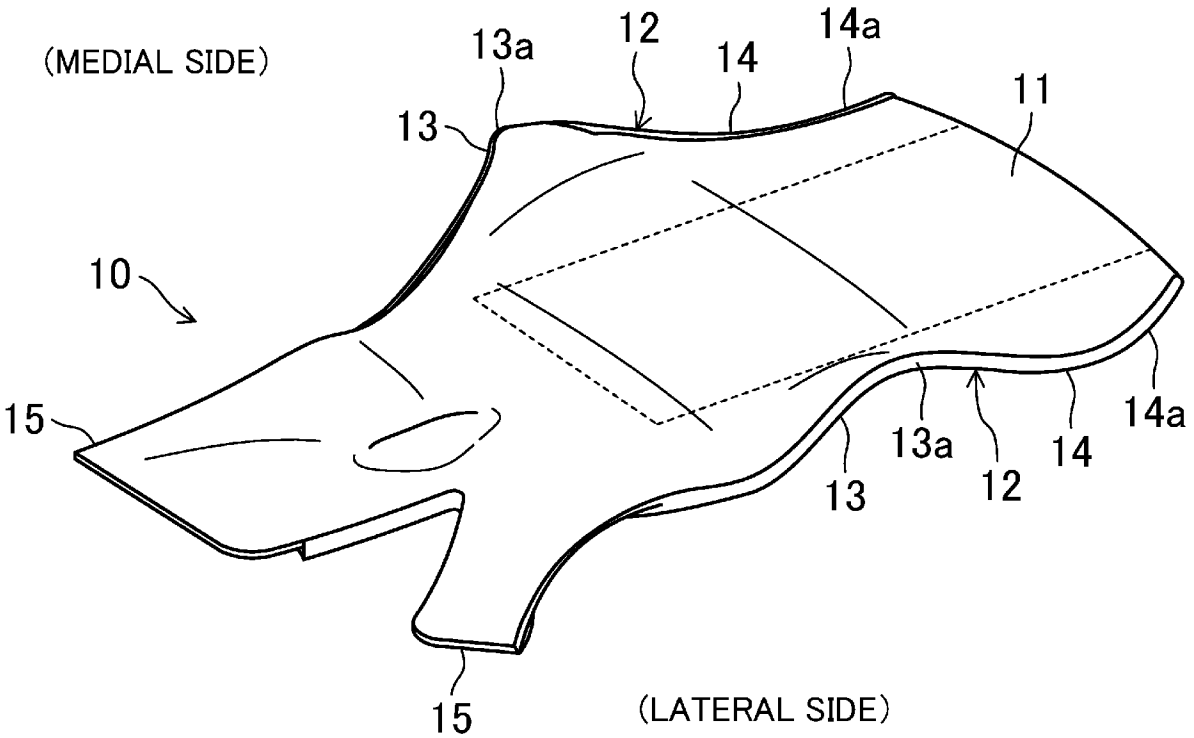
FIG. 4 is a perspective view of a supporter.
Figure 5:
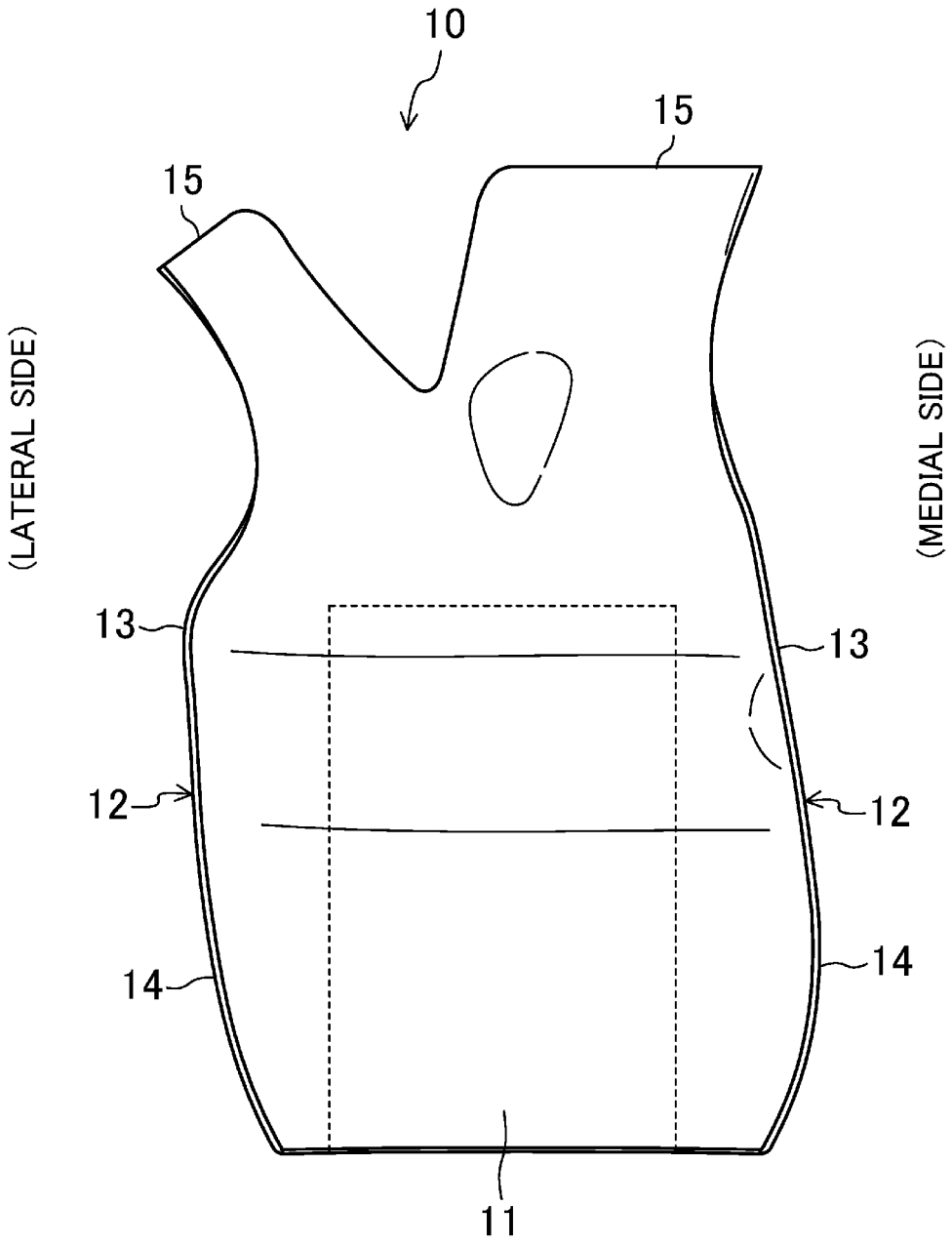
FIG. 5 is a plan view of the supporter.
Figure 6:
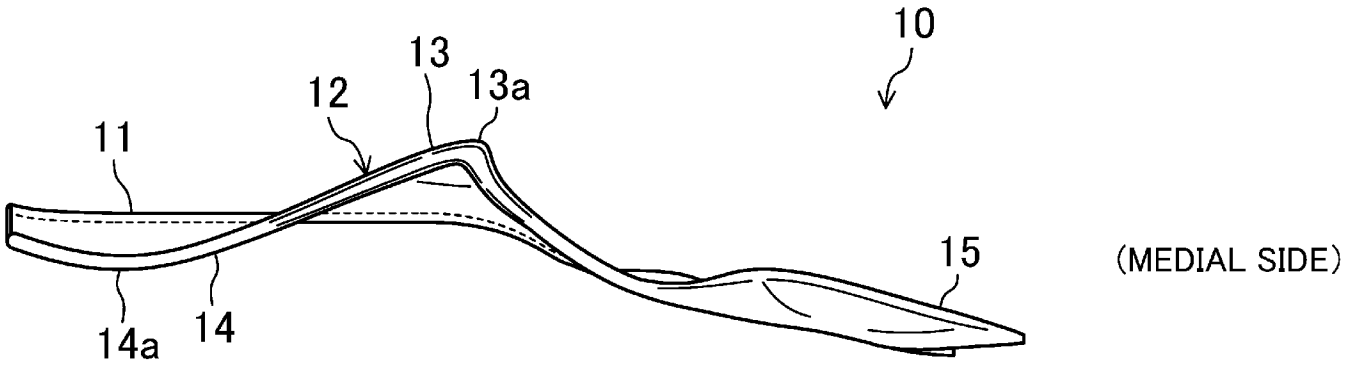
FIG. 6 is a medial side view of the supporter.
Figure 7:
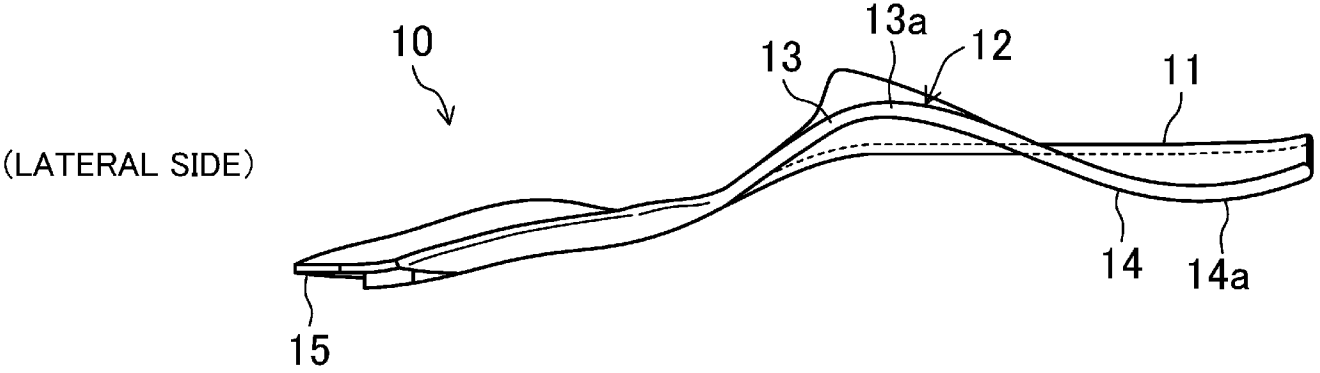
FIG. 7 is a lateral side view of the supporter.

As shown in FIGS. 4 and 7, the supporter 10 includes the base 11 in the central region of the heel region H in the foot width direction between the medial and lateral sides. This base 11 extends longitudinally through the entire heel region H (as indicated by the broken lines in FIGS. 2-7) and supports the sole surface corresponding to the central region of the heel region H in the foot width direction. The upper surface of the base 11 is a flat surface. The flat surface does not have to be a completely flat surface but may also be a smooth surface with some unevenness.

As shown in FIGS. 2 and 3, the supporter 10 has corrugated sides 12 and 12 corresponding to the medial and lateral sides of the heel region H. The corrugated sides 12 and 12 are provided continuously with the sides of the base 11 in the foot width direction.

As shown in FIGS. 4 and 7, each corrugated side 12 has a ridge 13 that curves and protrudes upward. This ridge 13 has an apex 13*a* above the base 11. This apex 13*a* is located within a region extending from the front of the heel region H to the longitudinal center thereof (see FIGS. 2 and 3). The apex 13*a* of the ridge 13 on the medial side is sharper than the apex 13*a* of the ridge 13 on the lateral side.

Each corrugated side 12 also has a groove 14 that is provided continuously with the rear of the ridge 13. This groove 14 curves and protrudes downward in the opposite direction from the ridge 13 to be provided continuously smoothly with the rear of the ridge 13. The bottom 14*a* of the groove 14 is located below the base 11. The bottom 14*a* of the groove 14 is located at the rear of the heel region H. More specifically, the bottom 14*a* corresponds to the lower rear of the calcaneus h of the foot shown in FIGS. 2 and 3, which protrudes downward.

As shown in FIG. 8, the cross-section of the supporter 10 taken in the foot width direction between the ridges 13 and 13 on the medial and lateral sides is recessed like a cup with the base 11 as the bottom. The thickness of the upper midsole 3*a* on the supporter 10 is substantially uniform in the foot width direction. That is, in the region extending from the ridge 13 on the medial side to the ridge 13 on the lateral side, the upper midsole 3*a* exhibits uniform cushioning from the medial side to the lateral side.

The sole structure 1 has a cavity 4 between the lower midsole 3*b* and each of the ridges 13 and 13 on the medial and lateral sides (see FIGS. 2 and 3). The cavities 4 and 4 extend in the foot width direction. These cavities 4 and 4 allow the supporter 10 to easily bend downward toward the lower midsole 3*b* in the positions with the ridges 13 and 13 on the medial and lateral sides, thereby increasing shock absorption provided by the supporter 10.

On the other hand, as shown in FIG. 9, the cross-section of the supporter 10 taken in the foot width direction between the grooves 14 and 14 on the medial and lateral sides rises like a dome having the base 11 as the apex. The upper midsole 3*a* on the supporter 10 has a greater thickness on the medial and lateral sides of the heel region H than in the central portion of the heel region H in the foot width direction. That is, in the region extending from the groove 14 on the medial side to the groove 14 on the lateral side, the upper midsole 3*a* exhibits cushioning more effectively on the medial and lateral sides of the heel region H than in the central portion of the heel region H in the foot width direction.

As shown in FIGS. 1-3, the supporter 10 has a pair of branches 15 and 15 extending in two directions from the base 11 along the corrugated sides 12 to conform to the midfoot M (particularly the arch of the foot). As shown in FIGS. 4 and 7, each branch 15 is provided continuously with the respective front ends of the base 11 and one of the corrugated sides 12. One of the branches 15 extends from the base 11 to the medial side. The other branch 15 extends from one of the corrugated sides 12 to the lateral side. The tip of each branch 15 is sandwiched between the front outsole 2*a* and the upper midsole 3*a*. This pair of branches 15 and 15 supports the midfoot M (particularly the arch of the foot) on the medial and lateral sides.

Effects and Advantages of Embodiment

The following description is based on the assumption that, when a shoe touches the ground while the wearer is walking or running, a load path L (see the imaginary line of FIG. 1) occurs, which represents the shift of the body weight from the lateral side of the wearer's rearfoot (i.e. the heel region) H through the central region of the heel region H in the foot width direction, the central portion of the midfoot M, and the medial side of the forefoot F to the tiptoes. In the sole structure 1 according to this embodiment, the thickness of the upper midsole 3*a* varies in the region of the supporter 10 at the rear of the heel region H between the grooves 14 and 14. This variation increases cushioning of the upper midsole 3*a* more effectively on the medial and lateral sides than in the central portion in the foot width direction. This cushions the initial shock particularly when a shoe touches the ground at the rear of the heel region H on the lateral side. The central region of the heel region H in the foot width direction, the base 11 of the supporter 10 does not curve like the corrugated sides 12. This structure of the base 11 easily distributes the shock caused when the shoe touches the ground throughout the base 11 to cushion the shock on the central region of the heel region H in the foot width direction more significantly than in a case where the shock is cushioned by the midsole 3 only. In addition, the raised and grooves 13 and 14 of the curving corrugated sides 12 of the supporter 10 are stiff enough to prevent the sole structure 1 from being deformed largely in the heel region H and prevent the foot (particularly the ankle) from falling excessively toward the medial or lateral side, even when vertical shock is caused on the sole support surface 3*c* of the midsole 3. This stabilizes the heel region H to allow the wearer who is walking or running to shift his or her body weight along the optimum load path L. In this manner, this sole structure 1 supports the heel region H stably via the supporter 10, and allows the wearer who is walking or running to shift his or her body weight on the foot along the optimum load path L.

The base 11 of the supporter 10 has a flat surface. Thus, in the central region of the heel region H in the foot width direction, the shock caused when the shoe touches the ground is distributed throughout the base 11 to hardly cause local deformation of the base 11. That is, the entire base 11 is easily bent and deformed to stably absorb the shock on the central region of the heel region H in the foot width direction.

The base 11 of the supporter 10 extends longitudinally throughout the heel region H. Thus, the base 11 cushions the shock caused when the shoe touches the ground throughout the heel region H in the longitudinal direction in the central region of the heel region H in the foot width direction.

The apex 13*a* of the ridge 13 of each corrugated side 12 is located within a region extending from the front of the heel region H to the longitudinal center thereof. This increases the stiffness of the corrugated side 12 particularly from the front of the heel region H to the longitudinal center thereof.

Second Embodiment

Figure 10:
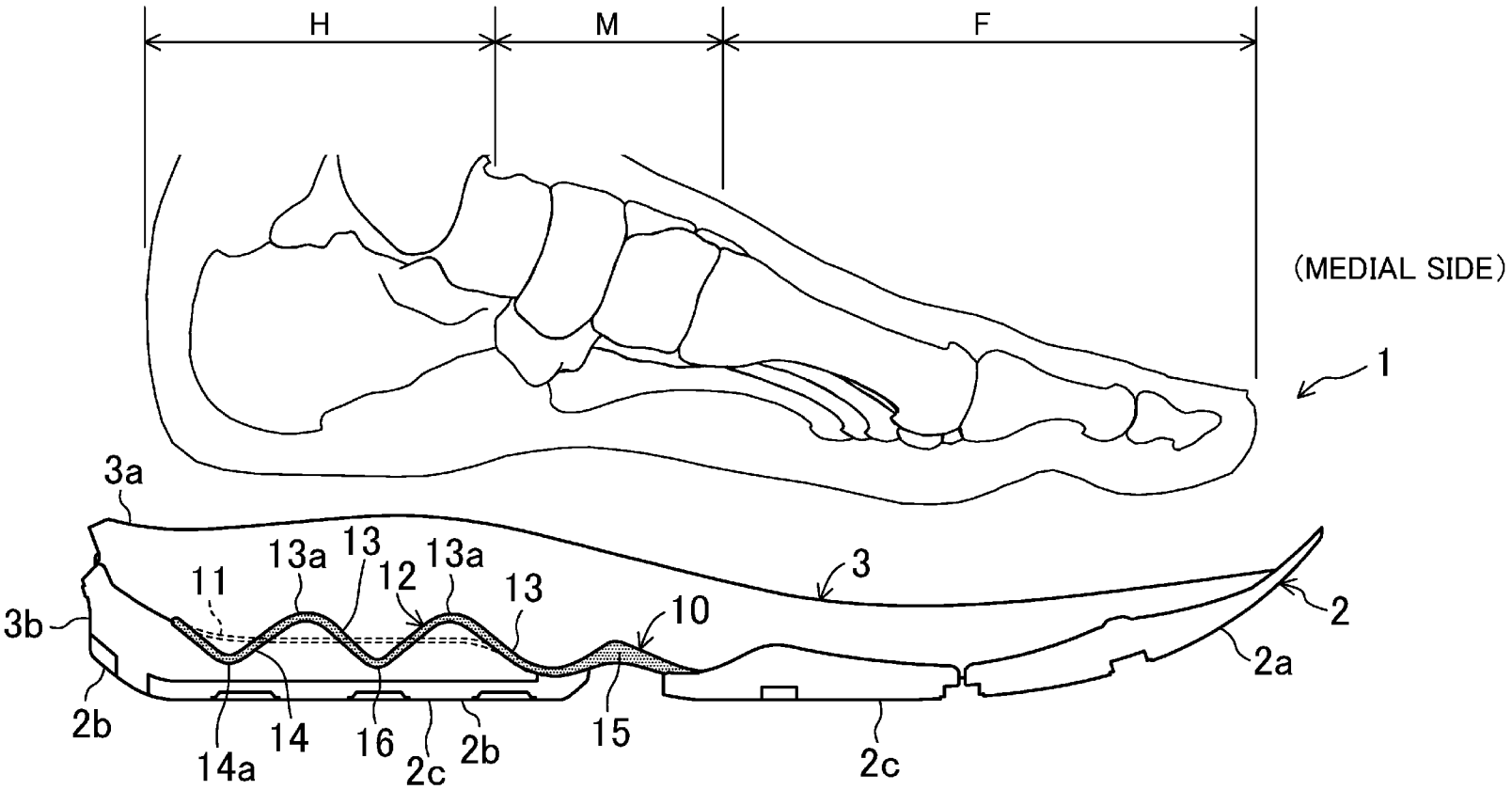
FIG. 10 illustrates a second embodiment and corresponds to FIG. 2.

FIG. 10 illustrates a sole structure 1 according to a second embodiment of the present disclosure. In this embodiment, the shape of the corrugated side 12 on the medial side is different from that in the first embodiment. In the other respects, the configurations of the sole structure 1 in this embodiment are the same or similar to those in the first embodiment. In the following description, the same reference characters as those shown in FIGS. 1-9 are used to represent equivalent elements, and the explanation thereof will be omitted.

As shown in FIG. 10, in this embodiment, a plurality of (e.g., two in the figure) ridges 13 and 13 are provided so as to be arranged longitudinally continuously with each other on the medial side of the heel region H. A recessed intermediate portion 16, which curves like the groove 14, is smoothly continuous between the ridges 13 and 13. The groove 14 is provided continuously with the rear of the ridge 13 located at the end. The recessed intermediate portion 16 does not necessarily curve like the groove 14.

The plurality of ridges 13 and 13 provided on the medial side further increases the stiffness of the corrugated side 12 on the medial side. This prevents the foot from excessively falling toward the medial side, thereby stabilizing the heel region H to allow the wearer who is walking or running to shift his or her body weight along an optimum load path, for example.

Other Embodiments

In the second embodiment, a plurality of ridges 13 and 13 are provided on the medial side of the heel region H. The embodiment is not limited thereto. Specifically, a plurality of ridges 13 and 13 may be provided to be arranged longitudinally continuously with each other on the lateral side of the heel region H. This structure further increases the stiffness of the corrugated side 12 on the lateral side of the heel region H. This allows the wearer to smoothly shift his or her body weight at side-step movements on the lateral side of the heel region H when he or she is playing sports such as baseball, football, volleyball, and basketball. A plurality of ridges 13 and 13 may be provided on both the medial and lateral sides of the heel region H.

While the embodiments of the present disclosure have been described above, the present disclosure is not limited to those embodiments. Variations and modifications may be readily made to hose embodiments within the scope of the present disclosure.

The present disclosure is industrially useful as a sole structure for, for example, athletic shoes for walking, running, and various sports, and rehabilitation shoes, as well as shoes of any of various types having the sole structure.

What is claimed is:

1. A sole structure for shoes, the structure comprising:

an outsole having a ground surface as a lower surface;

a midsole stacked on a top of the outsole and made of an elastic material; and a supporter provided around a middle of the midsole in a thickness direction, extending longitudinally to include a heel region of the midsole corresponding to a heel of a foot of a wearer, and being a thin layer and harder than the midsole, wherein the supporter includes a base provided at a position corresponding to a central region of the heel region of the midsole in a foot width direction, and a corrugated side provided continuously with each side of the base in the foot width direction, corresponding to a medial side and a lateral side of the heel region, the corrugated side including a ridge curving and protruding upward with its apex located above the base, and a groove provided continuously with a rear of the ridge, the groove curving and protruding downward with its bottom located below the base, the base is configured as one flat portion of the supporter, and is configured to extend in a longitudinal direction, which corresponds to a foot width direction, across both of the ridge and the groove provided in the heel region in a side view, the bottom of the groove is located at a rear of the heel region, and in a region extending from the groove on a medial side to the groove on a lateral side, the midsole on a top of the supporter has a greater thickness on the medial and lateral sides of the heel region than in a central portion of the heel region in the foot width direction.

2. The sole structure of claim 1, wherein the ridge includes a plurality of ridges being arranged longitudinally continuously with each other on the medial side, and the groove is provided continuously with a rear of rearmost one of the ridges.

3. A shoe comprising the sole structure of claim 2.

4. The sole structure of claim 1, wherein the ridge includes a plurality of ridges being arranged longitudinally continuously with each other on the lateral side, and the groove is provided continuously with a rear of rearmost one of the ridges.

5. The sole structure of claim 2, wherein the apex of each of the ridges is located within a region extending from a front of the heel region to a longitudinal center thereof.

6. A shoe comprising the sole structure of claim 5.

7. The sole structure of claim 4, wherein the apex of each of the ridges is located within a region extending from a front of the heel region to a longitudinal center thereof.

8. A shoe comprising the sole structure of claim 7.

9. A shoe comprising the sole structure of claim 4.

10. A shoe comprising the sole structure of claim 1.

* * * * *